US008078426B2

(12) United States Patent
Pipinich et al.

(10) Patent No.: US 8,078,426 B2
(45) Date of Patent: Dec. 13, 2011

(54) METRIC DISPLAY FOR EXERCISE EQUIPMENT

(75) Inventors: Victor Pipinich, Seattle, WA (US); Robert Silbernagel, Sammamish, WA (US); Sean Horita, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 549 days.

(21) Appl. No.: 11/646,850

(22) Filed: Dec. 28, 2006

(65) Prior Publication Data

US 2008/0161161 A1 Jul. 3, 2008

(51) Int. Cl.

| | |
|---|---|
| ***G01B 3/08*** | (2006.01) |
| ***G01C 7/00*** | (2006.01) |
| ***G06F 7/02*** | (2006.01) |
| ***G06F 13/12*** | (2006.01) |

(52) U.S. Cl. ..... 702/165; 702/160; 702/179; 702/186

(58) Field of Classification Search ..... 702/119, 702/122, 127, 176, 182, 185, 165, 142, 150, 702/158, 160, 179.186; 340/573.1; 701/213; 482/8; 715/700, 961

See application file for complete search history.

(56) References Cited

U.S. PATENT DOCUMENTS

| | | | | |
|---|---|---|---|---|
| 4,708,337 | A * | 11/1987 | Shyu | 482/54 |
| 5,149,084 | A | 9/1992 | Dalebout et al. | 482/3 |
| 5,213,555 | A | 5/1993 | Hood et al. | 482/57 |
| 5,466,200 | A | 11/1995 | Ulrich et al. | 482/4 |
| 5,554,033 | A | 9/1996 | Bizzi et al. | 434/247 |
| 5,591,104 | A | 1/1997 | Andrus et al. | 482/7 |
| 5,769,755 | A * | 6/1998 | Henry et al. | 482/8 |
| 5,888,172 | A | 3/1999 | Andrus et al. | 482/7 |
| 5,890,995 | A | 4/1999 | Bobick et al. | 482/4 |
| 6,042,519 | A | 3/2000 | Shea | 482/57 |
| 6,152,856 | A | 11/2000 | Studor et al. | 482/8 |
| 6,227,968 | B1 | 5/2001 | Suzuki et al. | 463/7 |
| 6,336,891 | B1 | 1/2002 | Fedrigon et al. | 482/8 |
| 6,428,449 | B1 * | 8/2002 | Apseloff | 482/3 |
| 6,447,424 | B1 * | 9/2002 | Ashby et al. | 482/8 |
| 6,885,971 | B2 * | 4/2005 | Vock et al. | 702/182 |
| 6,941,239 | B2 * | 9/2005 | Unuma et al. | 702/141 |
| 7,056,265 | B1 * | 6/2006 | Shea | 482/8 |
| 7,245,430 | B2 * | 7/2007 | Kobayashi et al. | 359/464 |
| 7,264,554 | B2 * | 9/2007 | Bentley | 473/222 |
| 7,292,151 | B2 * | 11/2007 | Ferguson et al. | 340/573.1 |
| 7,308,818 | B2 * | 12/2007 | Considine et al. | 73/12.09 |
| 7,435,203 | B2 * | 10/2008 | Anderson et al. | 482/52 |
| 7,602,301 | B1 * | 10/2009 | Stirling et al. | 340/573.1 |
| 2002/0019258 | A1 | 2/2002 | Kim et al. | 463/36 |
| 2005/0124466 | A1 | 6/2005 | Rodgers, Jr. | 482/52 |
| 2005/0124467 | A1 | 6/2005 | Rodgers, Jr. | 482/52 |
| 2007/0008318 | A1 * | 1/2007 | Matsumoto | 345/424 |
| 2007/0135225 | A1 * | 6/2007 | Nieminen et al. | 473/212 |

* cited by examiner

*Primary Examiner* — Michael Nghiem
*Assistant Examiner* — Felix E Suarez
(74) *Attorney, Agent, or Firm* — Terence P. O'Brien; Todd A. Rathe

(57) ABSTRACT

A display system for exercise equipment in accordance with the present invention includes a processor, a memory, a metric sensor and a metric display. The memory in communication with the processor. The metric sensor operably coupled to the processor. The metric sensor senses an extent of a metric of a user of the exercise equipment. The metric display is operably coupled to the metric sensor and displays the user metric in a generally oscillating manner.

57 Claims, 11 Drawing Sheets

METRIC DISPLAY FOR EXERCISE EQUIPMENT

FIELD OF THE INVENTION

The present invention relates to a display for exercise equipment.

BACKGROUND OF THE INVENTION

The benefits of regular aerobic exercise have been well established and accepted. However, due to time constraints, inclement weather, and other reasons, many people are prevented from aerobic activities such as walking, jogging, running, and swimming. As a result, a variety of exercise equipment has been developed for aerobic activity.

From their humble beginnings as free weights and bicycles mounted on wooden platforms, exercise equipment such as stationary bicycles, elliptical exercise equipment, stair climbers, and the like have grown increasingly sophisticated. However, the very advantage of the exercise equipment described above—the ability to use such equipment conveniently, in a relatively confined space, and in inclement weather—results in exercise devices that can be relatively monotonous to use for some users.

It is well known that the more stimulating and enjoyable the experience of exercising is to a user, the longer and more frequently that user will exercise. Unfortunately, many users find spending long hours doing repetitive forms of stationary exercise hard work and boring, sometimes so much so that the exercise equipment is abandoned in favor of something more entertaining.

Accordingly, many exercise equipment users and exercise equipment design allow for the user to vary his or her motion during use. Treadmills, for example, enable a user to vary his or her pace or stride from a walk, to a jog or to a sprint. Many steppers and elliptical exercise machines enable a user to vary his or her stride length or stride angle to achieve different motions. Still other exercise devices enable a user to select from or two or more different exercise paths during use. The flexibility of such exercise devices provides a user with a broader range of available exercise routines or motions making the exercise machines more enjoyable to use in a repetitive manner. Such workout flexibility provides a user the ability to exercise different or more muscle groups.

Additionally, exercise equipment users are often increasingly more interested in monitoring their workout on exercise equipment, including monitoring such parameters as speed, distance, heart rate, resistance, calories burned, and other available parameters. However, in many existing exercise devices, communicating such information to users requires the user to manipulate numerous controls or to navigate many display screens or windows in order to access desired workout information.

Thus, a continuing need exists for a display for exercise equipment that provides additional information to the user. Additionally, there is a continuing need for improved displays that are specifically configured for exercise devices with multiple exercise positions, paths, motions, stride lengths and/or stride angles. What is needed is a type of display that can communicate a user's current path, stride length, motion etc. on an exercise device in a manner that is immediate, user-friendly and effective. It is desirable to provide such an improved display for exercise equipment that makes exercise more enjoyable for the user and improves the feedback of the user's motion, path or stride to the user.

SUMMARY OF THE INVENTION

The present invention provides a display system for exercise equipment includes a processor, a memory, a metric sensor and a metric display. The display system is in communication with a remote processor. The memory and the metric sensor are in communication with the processor. The metric sensor senses an extent of a metric of a user of the exercise equipment. The metric display is in communication with the processor. The metric display displays the user metric in a generally oscillating manner.

According to a principal aspect of a preferred form of the invention, a metric display system for an exercise equipment display system. The metric display system includes a position sensor and a metric display. The position sensor senses an extent of a metric of a user of the exercise equipment. The metric display is in communication with the position sensor. The metric display is configured to display the metric in an oscillating manner proportional to the extent of the metric.

According to another preferred aspect of the invention, a display for a user metric on exercise equipment includes a plurality of light bars. The light bars display an extent of the user metric. The light bars are grouped into at least first and second zones corresponding to different amounts of the extent of the user metric. The light bars of the first zone produce a light of a first color, and the light bars of the second zone produce a light of a second color that is different from the first color.

This invention will become more fully understood from the following detailed description, taken in conjunction with the accompanying drawings described herein below, and wherein like reference numerals refer to like parts.

DETAILED DESCRIPTION

While an exemplary embodiment of the invention has been illustrated and described, it will be appreciated that various changes can be made therein without departing from the spirit and scope of the invention.

Figure 1:
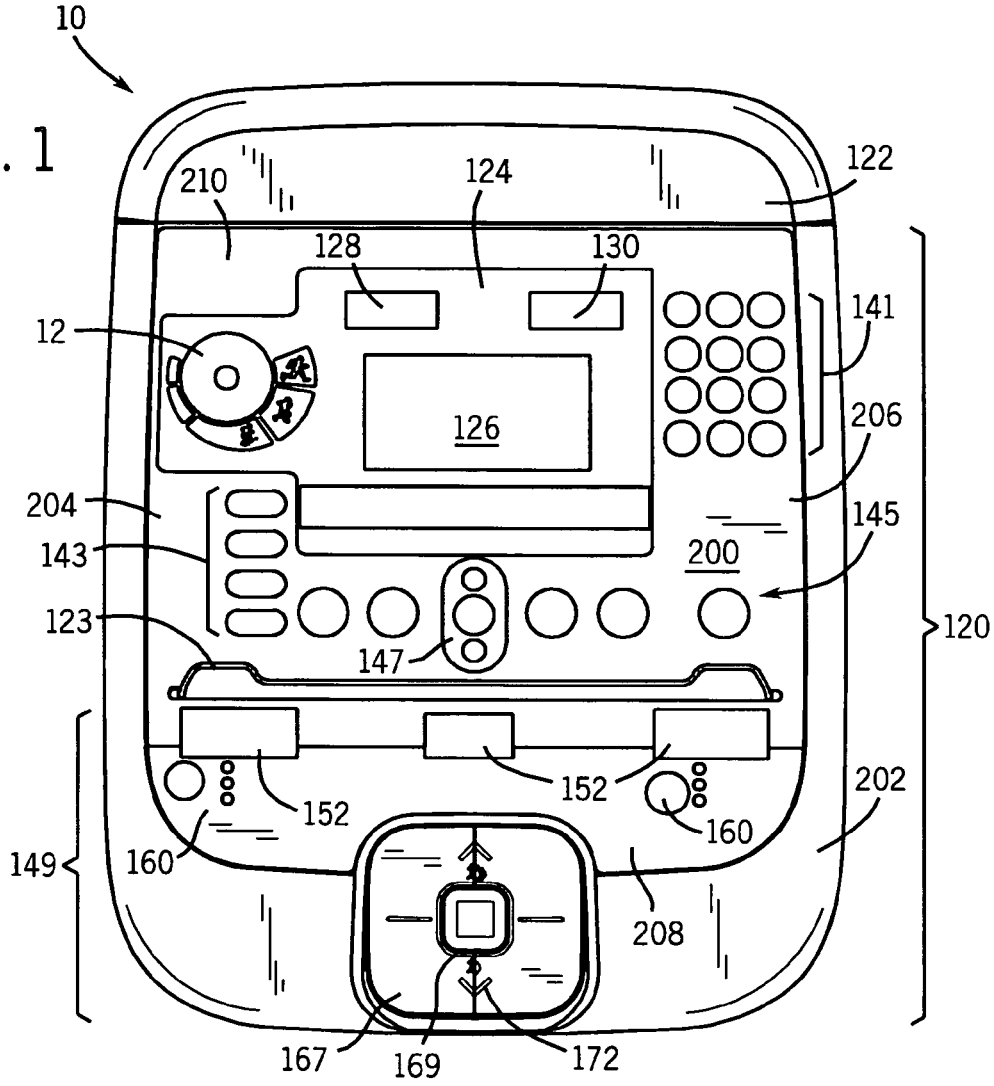
FIG. 1 is a front perspective view of a display system for exercise equipment.

Referring to FIG. 1, a front perspective view of one embodiment of a display system 10 for exercise or fitness equipment is seen. The display includes a metric display 12 in accordance with the principles of the present invention. While in the described embodiment the metric display is a graphical dial 12 as described in more detail below, other metric displays can convey this same information. For example, a bar graph, or an alternate form of graphical display, could be utilized.

While the principles of the metric display for exercise equipment of the present invention are applicable to virtually any exercise equipment display, the present description can make use of the disclosure of U.S. patent application Ser. No. 11/388,565 filed on Mar. 24, 2006 and entitled "Flexible Display Assembly for Fitness Trainers," which is owned by the same assignee as the present application and the disclosure of which is incorporated herein by this reference. The display system 10 can convey information both to and from the user. The display system 10 can include a base unit 120 and a first upper module 122. The base unit 120 has a generally planar front operating surface 200 including a plurality of controls and display windows. The base unit 120 can further include an edge region 202 generally framing at least three side edges of the operating surface 200, first and second side edges 204 and lower and upper edges 208 and 210. The edge region 202 is positioned adjacent the first and second side edges 204 and 206 and the lower edge region 206.

The base unit 120 can include a publication holder 123. The base unit 120 also includes a display area 124 that, in one embodiment, can comprise a central screen 126 and first and second peripheral displays 128, 130. The central screen 126 can be used to select and monitor the most frequently used exercise programs from a single layer list while less frequently used exercise programs may also be accessed through a deep display list. Such programs can be related to time, calories, metabolic equivalents (METs), distance or other factors. In one embodiment, the first and second peripheral screens 128 and 130 can display operational parameters of the exercise equipment such as, for example, calories burned, heart rate, speed, distance, resistance level, etc. The display area 124 can also include the metric display 12 described in more detail below.

A display control area 145 can be provided that can include increment/decrement arrows 147, a "back" button, an "options" button, and an "OK" button. The base unit 120 can further include a numerical key area 141 that includes the numerals 0-9 as well as a clear key and an input key. In one preferred embodiment, the numerical key area 141, or other controls on the base unit 120, can be used to operate audio and/or visual components positioned either above, or remote from, the base unit 120. In addition, a programs key area 143 can be provided that can include a plurality of pre-programmed generic or user specific exercise routines or programs. The base unit 120 can further include a lower base area 149. The lower base area 149 can comprise a plurality of peripheral display areas 152. The peripheral display areas 152 can include display selection buttons 160 for the user to select from the available display options.

In one embodiment, the lower base area 149 can further include a centrally positioned, raised input area 167. The raised input area 167 can include a "quick start" button 169, pursuant to which the user can start the fitness device with a single input function. In addition, adjust increment/decrement arrows 172 can be provided on the input area 167. The adjust increment/decrement arrows 172 enables the use to change the setting of the fitness trainer with a single control input at any time during the workout.

Figure 2:
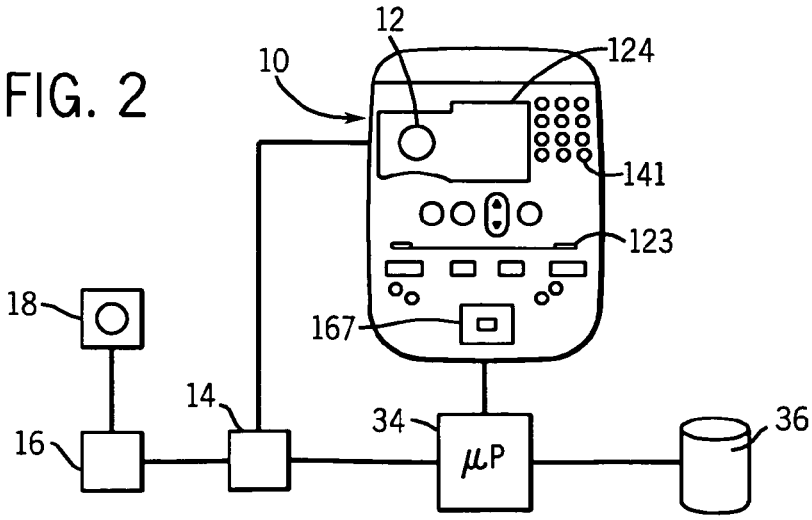
FIG. 2 is a schematic of example architecture of a display system for exercise equipment in accordance with the principles of the present invention.

Referring to FIG. 2, a schematic of example architecture of the metric display 12 in accordance with the principles of the present invention is seen. The display system 10 can include a microprocessor 34 that is connected to the display system 10. The microprocessor 34 is further connected to memory 36. In one embodiment, the display system 10 can include a display console circuit board such as a T2 board; the microprocessor can be a microcontroller such as for example an Atmel ATmega128 microprocessor with 16 MHz clock available from Atmel Corporation, 2325 Orchard Parkway, San Jose, Calif. 95131 USA; the memory can be flash memory, Erasable Programmable Read-Only Memory (EPROM); Random Access memory (RAM); and Electrically Erasable Programmable Read-Only Memory (EEPROM).

The T2 board can include a connector for loading and reading flash and EEPROM memory. The connector can be for example a JTAG connector available from JTAG Technologies Inc., 1006 Butterworth Court, Stevensville, Md. 21666 USA. Multiple serial ports can be provided for: communications with the local processor; Communication Specification for Fitness Equipment (CSAFE) communications; and USB, wireless or other form of network interface.

Electronic devices may be incorporated into the display system 10 such as timers, odometers, speedometers, heart rate indicators, energy expenditure recorders, controls, etc. To allow time-stamping of workout records, an internal clock with an internal battery backup and a user interface to allow the user to adjust the time can be provided. A speed sensor can be preferably provided. In one embodiment, the speed sensor can be based on zero crossing of one phase of a SPAM generator, 51 pulses per revolution or 2 strides. A resistance can be provided by a generator or a brake system. The display system 10 can also include a heart rate interface having a heart rate receiver and display window. In one embodiment the heart rate receiver can be supplied from Polar Electro Inc., 1111 Marcus Avenue, Suite M15, Lake Success, N.Y. 11042 USA.

Referring to FIGS. 1 and 2, the upper module 122 of the display system 10 can be removably coupled to, and can enclose, the upper end of the base unit 120. The first upper module 122 can be configured to conform to and complement the shape of the base unit 120. As described in detail in U.S. patent application Ser. No. 11/388,565, the upper module 122 can incorporate various functionalities and can be interchanged and/or upgraded with minimal effort by the manufacturer or service provider.

As seen in FIG. 2, the display 12 for exercise equipment includes a display electronics board 14 (an upper display printed circuit system PCA), which generates the position information for the display 12. The display electronics board 14 receives a signal from a lower level PCA 16 representative of user position. The lower level PCA 16 receives its position information from a positional sensor 18. Thus, the following chain:

POSITIONAL SENSOR-->LOWER PCA-->UPPER DISPLAY PCA-->METRIC DISPLAY

Examples of such positional sensor 18 can include an optical position sensor for a pendulum motion exercise apparatus, a displacement sensor, a deflection sensor or a load sensor such as a Linearly Variable Differential Transformer (LVDT) or a strain gauge for a treadmill device, and the like.

Figure 3:
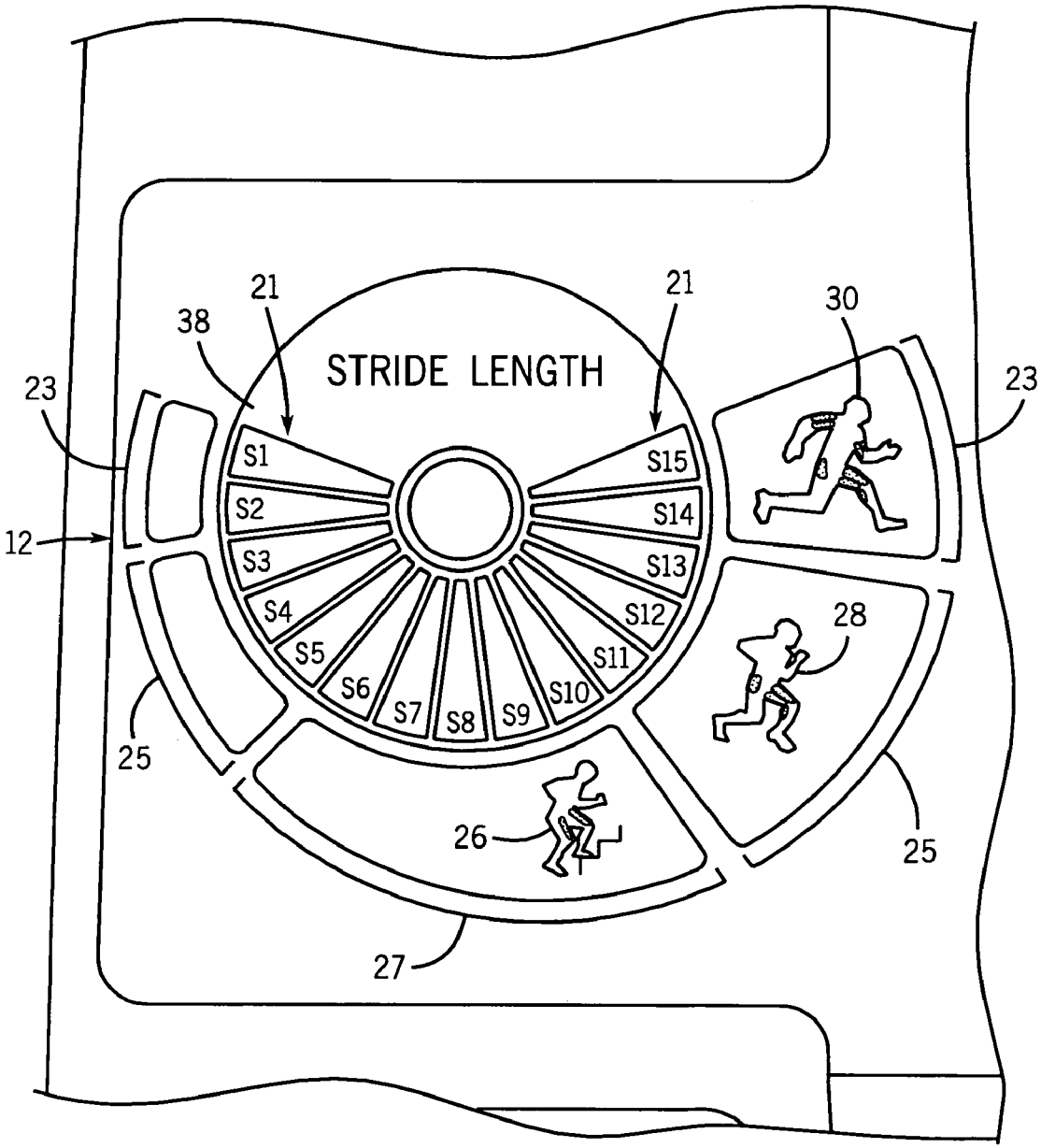
FIG. 3 is a detailed view of a metric display for exercise equipment in accordance with the principles of the present invention

Referring to FIG. 3, a detailed view of the metric display 12 for exercise equipment in accordance with the principles of the present invention is seen. In this illustrative embodiment, the metric display 12 is configured as a pendulum motion-type exercise device that allows the user to operate the device with a number of different foot motions. The pendulum motion-type device enables the user to use a stepping type foot motion with limited horizontal movement, a generally elliptical foot motion that resembles walking or jogging, and more elongated elliptical foot motion that resembles running or an arcuate swinging foot motion. Again, while one embodiment of the metric display 12 is described, other forms of displays can also be used. Further, while in the described embodiment the metric displayed is user foot motion, other metrics such as, for example: arm extension; body extension; angle of a path defined by a user's foot motion; stride length; shape defined by a user's foot motion, and stride height or amplitude of a user's foot motion can be used. One or more of these metrics can be applied other types of exercise devices, such as elliptical machines, steppers, treadmills, etc.

The metric display 12 includes a plurality of display bars 21 which can be, as in this example, fifteen. In alternative embodiments, other quantities of display bars can be used. The display bars 21 display a metric of the user, such as the foot motion of the user and track the extent of the metric, such as the length of the foot motion in a generally horizontal direction. The plurality of display bars 21 can be grouped into regions or metric operating zones corresponding to different regions or zones of the foot motion of the user. Thus, continuing the example of fifteen display bars 21, the display bars one, two, and fourteen, fifteen can represent a relative long stride zone 23 (or the limits of the long stride zone 23); display bars three through five and eleven through thirteen can represent a relative middle stride zone 25 (or the limits of the middle stride zone), and display bars six through ten can represent a shorter horizontal stride zone 27 (or the limits of the shorter horizontal stride zone).

In one embodiment, each of the stride zones can be color coordinated to convey information regarding the extent of the metric of the user, such as the generally horizontal length of the foot motion of the user. Thus, in one embodiment: the relatively shorter horizontal stride zone 27 can comprise the color green to designate that the user is in a stepping-type foot motion with limited generally horizontal movement; the relative middle stride zone 25 can comprise the color yellow to designate the user has transitioned to a longer stride zone; and the relative long stride zone 23 can be colored orange designating that the user has reached maximum stride operating position. Alternatively, in some applications, the green color can be used to communicate to the user that he or she is operating the exercise device in a "safe" striding zone; the yellow color produced by the display bars corresponding to a user's stride can be used to communicate to the user that he or she may be pushing beyond the "safe" stride zone, and the orange color produced by the display bars can be used to communicate that the user may be overexerting/risking injury.

In another embodiment, each of the stride zones can further include human icons 26, 28, 30 corresponding to the stride zones 23, 25, 27 that display graphic information on the length of stride as well as the muscle groups being taxed. Thus, icon 26 can correspond to the relative shorter horizontal stride zone 27 and can highlight those muscle groups utilized during a stepping foot motion. Icon 28 can correspond to the relative middle stride zone 25 and can highlight those muscle groups utilized during walking or jogging. Icon 30 can correspond to the relative long stride zone 23 and can highlight the muscle groups utilized while running.

Figure 4:
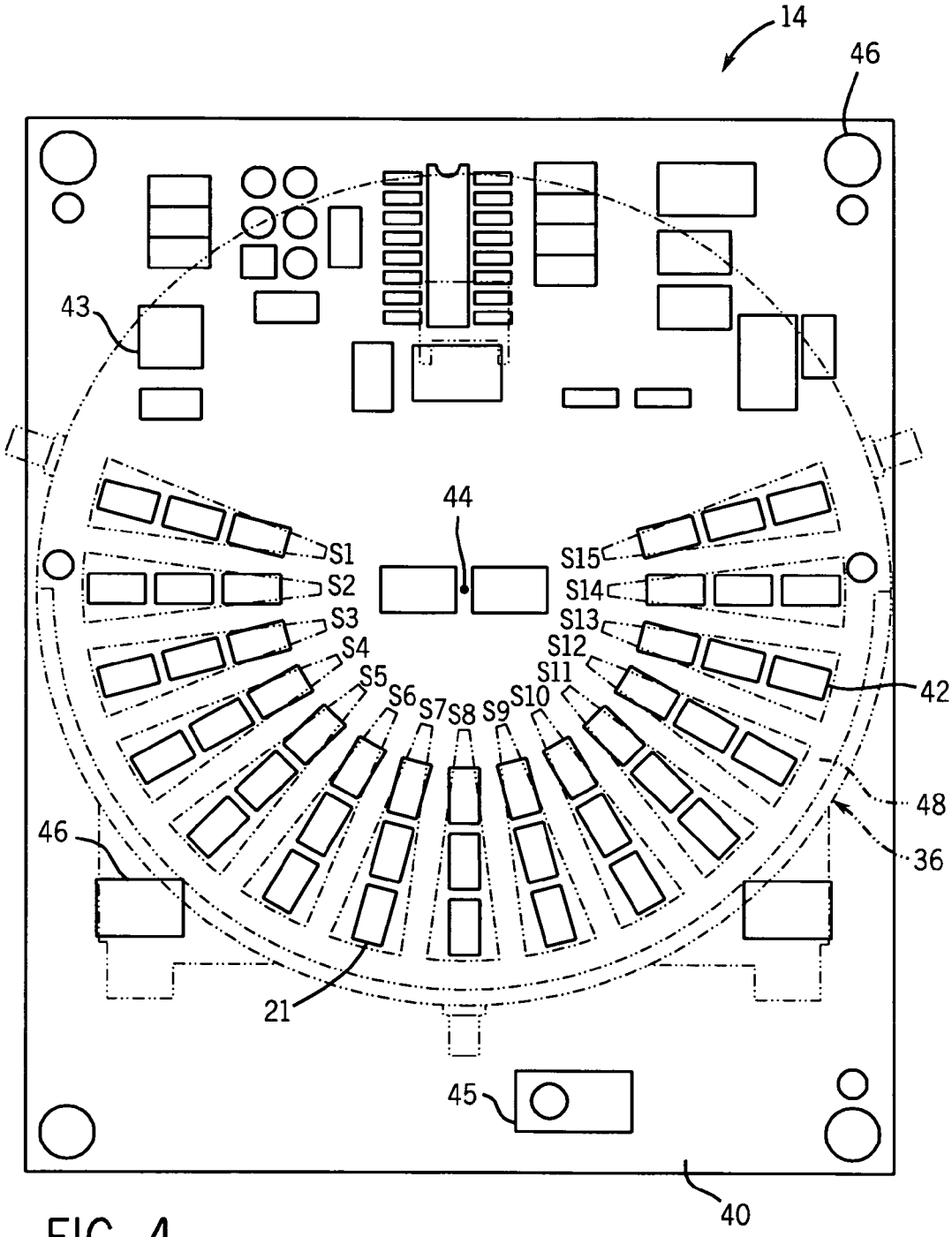
FIG. 4 is a diagram of one embodiment of a display electronics board of the metric display for exercise equipment of FIG. 3 including a partition housing shown in phantom.
Figure 5:
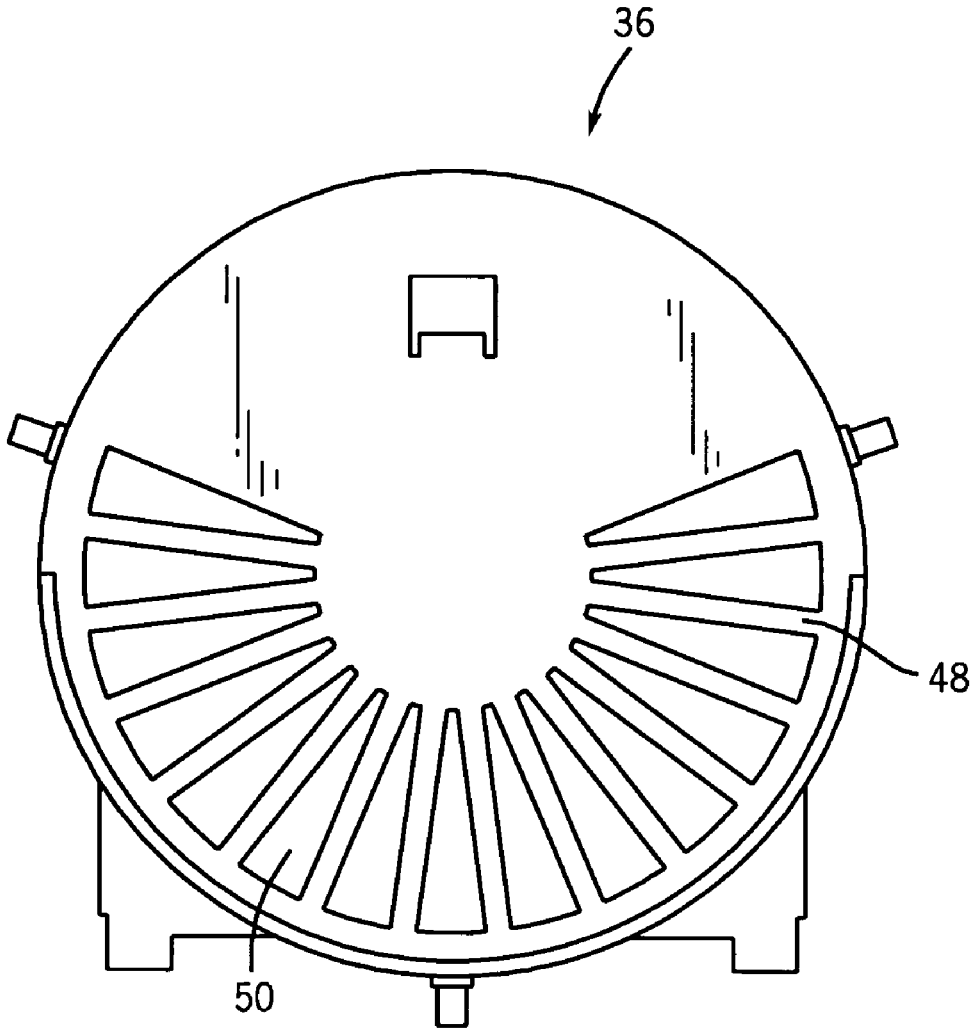
FIG. 5 is a front perspective view of a partition housing of the metric display of FIG. 3.

Referring to FIGS. 3 through 5 the metric display 12 of one embodiment is shown in greater detail. The metric display 12 includes the display electronics board 14, a partition housing 36, and an overlay 38. The display electronic board 14 includes a circuit board 40, a plurality of light emitting diodes (LEDs) 42, a microprocessor 43 and other circuitry for processing position signals received from the lower level PCB 16 representative of user position on the exercise device. Additionally, the display electronic board 14 is operably coupled to the display system 10 including the microprocessor 34. Alternatively, the display electronic board may not be coupled to one or more additional microprocessors. The plurality of LEDs 42 define an operating display region. In one embodiment, forty-five (45) LEDs 42 are coupled to the circuit board 40, wherein a row of three LEDs 42 represent a single light bar 21 thereby forming fifteen separate light bars 21. In other embodiments, other quantities of LEDs can be used to form a single light bar and the total number of light bars (and LEDs 42) can also be varied. The LEDs are positioned about a central region 44 of the electronics board 14 and each light bar 21 of three LEDs radiates outwardly from the central region 44.

The partition housing 36 is coupled to the electronics board 14 through openings 46 in the electronic board 14. The partition housing 36 extends over the electronics board and includes a plurality of partitions 48 defining a plurality of generally pie-slice shaped openings 50. Each opening 50 is aligned with and corresponds to a row of three LEDs 42 on the electronics board 14. The openings 50 enable light emitted from a particular row of three LEDs to pass through the housing 36, and the partitions 48 inhibit the light from bleeding into adjacent openings 50 (or slices). The housing 36 is formed of a lightweight durable material, preferably a plastic. Alternatively, other materials can be used. In alternative preferred embodiments, the partitions and/or LED arrangement can be configured to form openings or patterns of different shapes and/or different sizes. The number of openings 50 can also be varied.

The overlay 38 is positioned over the partition housing 36. The overlay 38 diffuses the light emitted by the LEDs 42 and passing through the openings 50. The overlay 38 blends the light emitted by the row of three LEDs 42 together to provide the appearance of a single solid bar of light (the light bar 21). The overlay 38 is preferably formed of a translucent material. Alternatively, the overlay can be formed of transparent, semi-transparent and/or semi-translucent materials. In one embodiment, the overlay 38 has an opaque appearance such that when the LEDs 42 are not energized, the appearance of the overlay 38 is dark or black in color. When the LEDs 42 are energized, the light is diffused and shown through the overlay 38. The contrast between the opaque color of the portion of the overlay 38 over the de-energized LEDs and the portion of the overlay 38 over the energized LEDs accentuates the appearance of the light bar 21 on the display 12. In one embodiment, the partitions 48 and the overlay 38 inhibit light from bleeding over into adjacent openings 50 thereby providing the metric display 14 with a very sharp and clean appearance as the light bars 21 energize and de-energize to track the foot motion of the user. In an alternative embodiment, the partitions 48 and/or the overlay 38 can be configured to direct and diffuse the light from the LEDs 42 such that the solid light bar 21 is formed and a small amount of light radiates to either side of the light bar 21 providing a wider, glowing or sweeping appearance to the light bar 21, as the light bars energize and de-energize to track the foot motion of the user.

The light bars 21 are represented as S1 through S15. In accordance with the embodiment, the stride zones 23, 25 and 27 can be color coordinated as described above, the LEDs can be configured to provide different colors such that a separate color can designate a separate stride zone. The LEDs 42 forming the light bars 21 designated as S6 through S10 can generate a green color. The LEDs 42 forming the light bars 21 designated as S3 through S5 and S11 through S13 can generate a yellow color. Finally, the LEDs forming the light bars 21 designated as S1 and S2 and S14 and S15 can generate an orange color. Alternatively, the overlay 38 can be colored or tinted to alter the color of the light as different LEDs or light bars are energized. In other embodiments, other colors and color combinations can be used. In other embodiments, more or less stride zones (or other designated zones) can be used.

Figure 6:
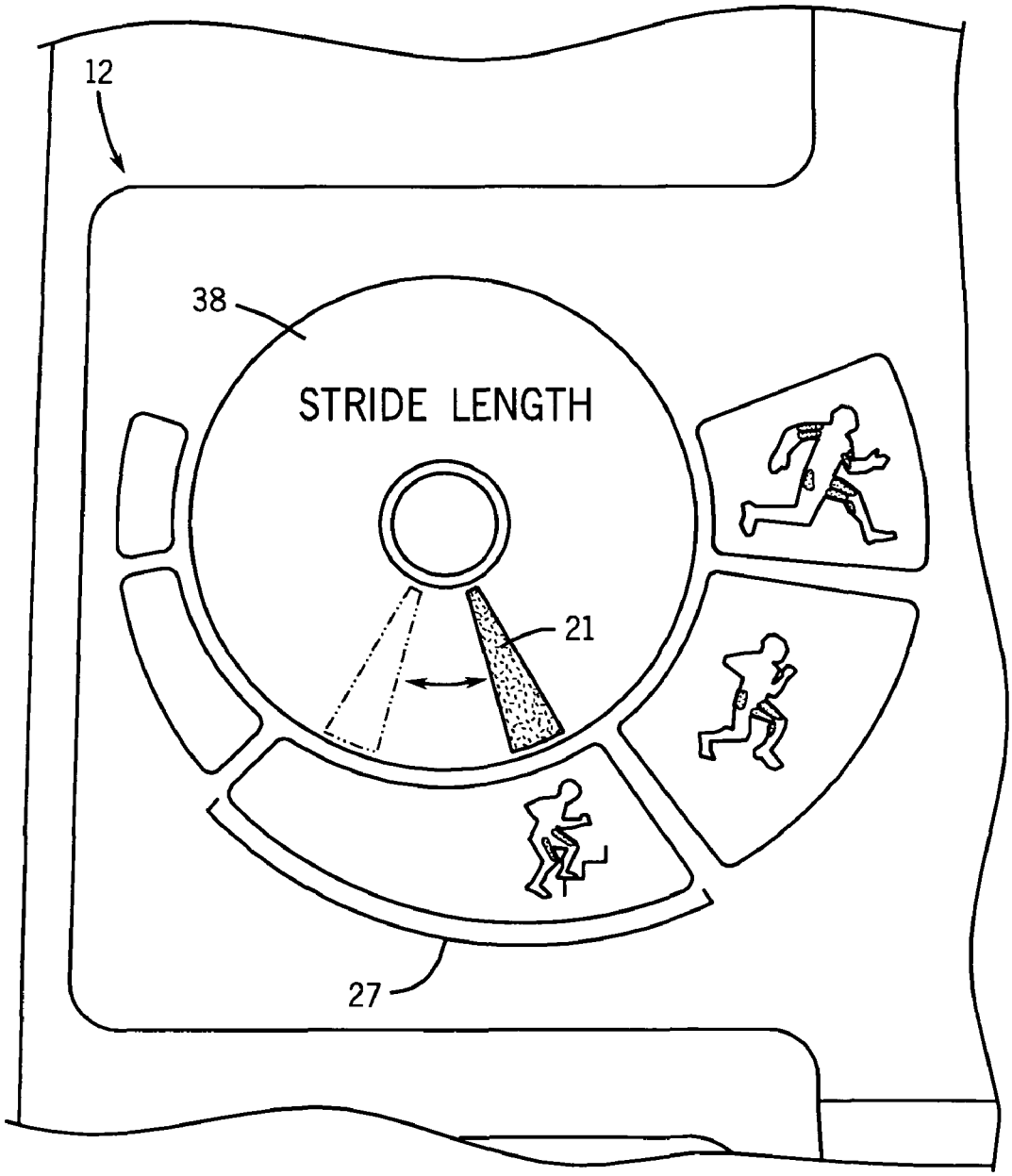
FIG. 6 is a front view of a metric display for exercise equipment indicating operation within a first metric operating zone.
Figure 7:
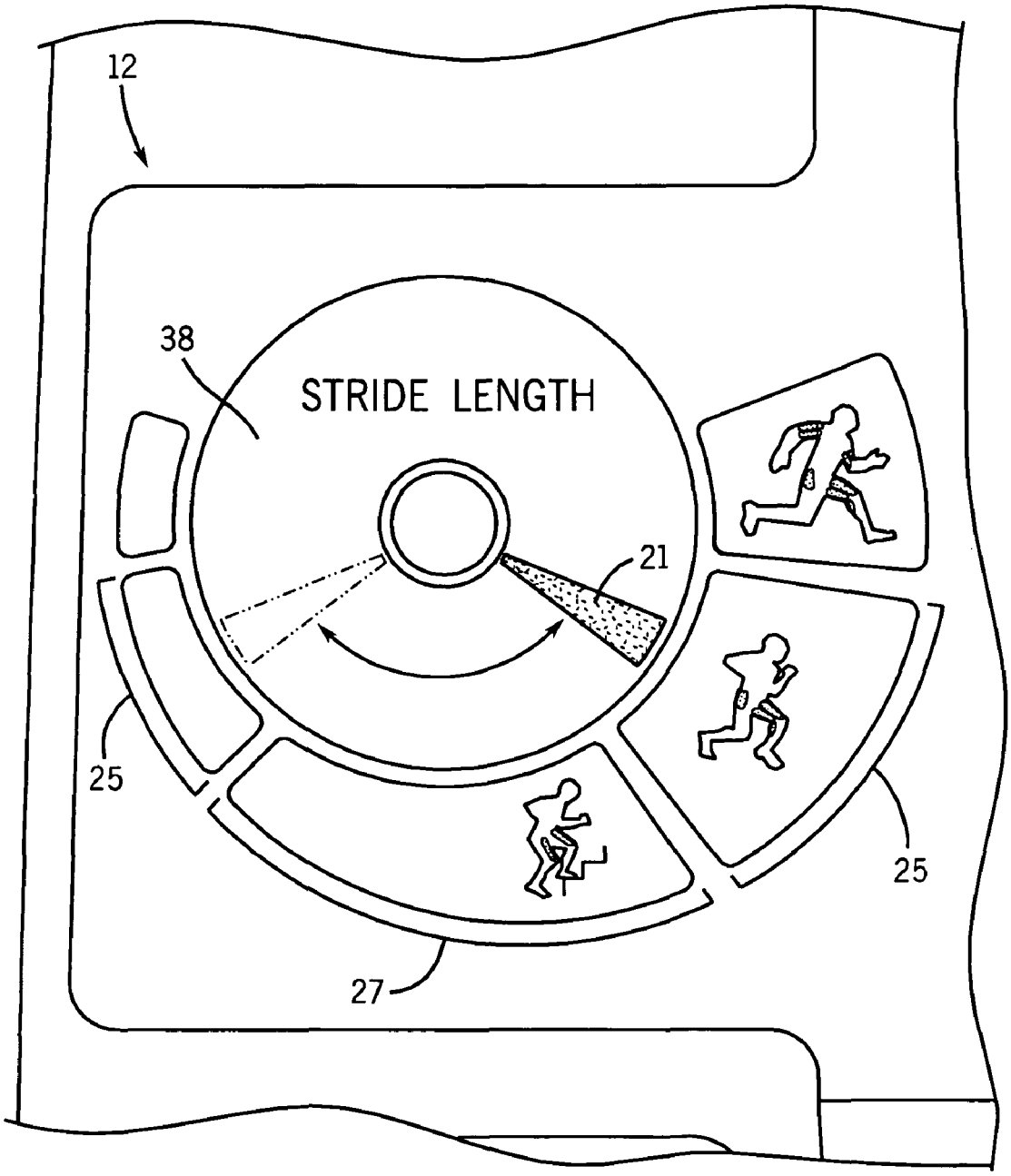
FIG. 7 is a front view of a metric display for exercise equipment indicating operation in a second metric operating zone.
Figure 8:
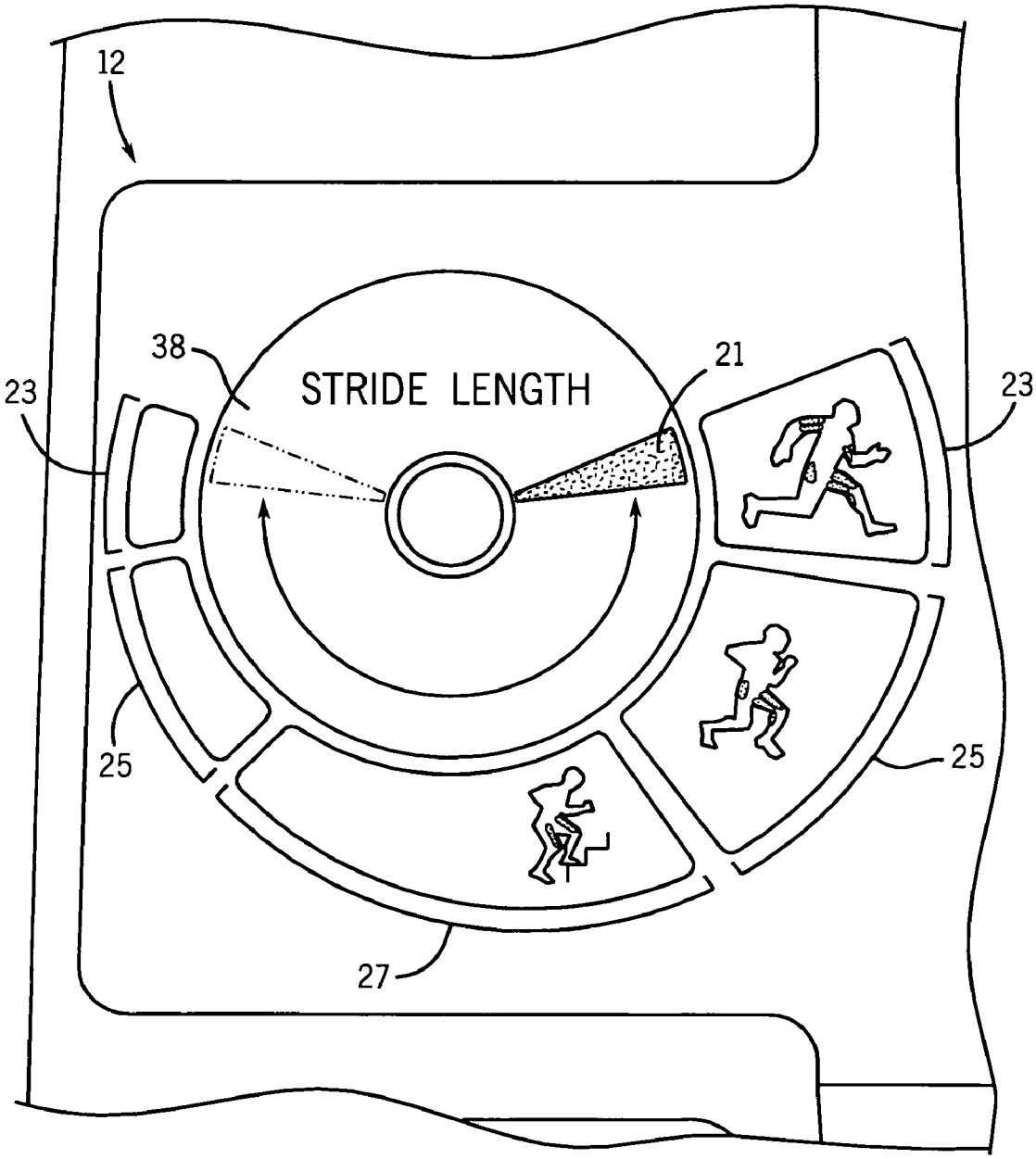
FIG. 8 is a front view of a metric display for exercise equipment indicating operation in a third metric operating zone.

Referring to FIGS. 6-8, the light bars 21 energized through different stride zones 23, 25 and 27 are illustrated. In FIG. 6, the light bar 21 is shown in operation in the shorter horizontal stride zone 27 wherein the light bar 21 is colored green by the LEDs. The stride zone 27 depicts when the user foot motion is in the shorter horizontal stride region of travel, such as when the user is in a stepping motion or when the user intentionally chooses to use a short horizontal stride. In one embodiment, the metric display 12 is essentially dark and a single light bar 21 is energized to show the approximate stride position of the user on the exercise device. Therefore, when the user is using a stepping motion and maintaining his or her horizontal stride length within the shorter horizontal stride region 27 the light bars 21 designated as S6 through S10 will energize and de-energize to track the stride of the user. Accordingly, the metric display 12 will provide the appearance of a light bar that is oscillating back and forth tracking the stride of the user. In other words, the movement of the light bar can simulate the motion of a pendulum swinging or oscillating back and forth. The speed of the swinging or oscillating motion is dependent upon the speed of the user's motion and the size, width and/or amplitude of the swing or oscillation of the light bar 21 is also dependent upon the length of the user's stride on the exercise device.

Referring to FIG. 7, when the user employs a slightly longer horizontal stride motion, such as when simulating a jogging or walking foot motion, the light bars 21 designated from S3 through S13 can become energized in an alternating, oscillating manner tracking the stride position of the user on the exercise device. As the user stride lengthens beyond the shorter horizontal stride zone 27 into the middle stride zone 25, the color of the light bar 21 also changes from green (for the stride zone 27) to yellow (for stride zone 25) and back again. Therefore, as the light bars 21 energize and de-energize to track the foot motion of the user, the color of the light bar 21 will change from a yellow when the user's stride extends into the stride zone 25 to green when the user's stride returns within the stride zone 27. The green color is maintained until the user's foot motion extends beyond the stride zone 27 thereby producing the yellow color. The light bar color then returns to green as the user's foot motion re-enters the stride zone 27, and the cycle continues as the user's foot motion continues. The total number of light bars 21 illuminated or energized during the user's motion is dependent upon the length of the user's stride. Accordingly, if the user's stride is long enough to extend just beyond the stride zone 27, then the light bars 21 designated as S5 through S11 may only be energized in the back and forth, sequential, oscillating manner. However, if the user's stride extends to a greater length so as to incorporate the entire stride zone 25 and the stride zone 27, then the light bars 21 designated as S3 through S13 will be energized and de-energized in a back and forth, sequential, oscillating manner.

Referring to FIG. 8, when the user's stride extends to simulate running, the length of the user's stride can extend into the stride range 23. Accordingly, the light bars 21 designated from S1 through S15 can become energize and de-energized in a back and forth, sequential, oscillating manner. The LEDs 42 forming the light bars 21 designated as S1, S2, S14 and S15 produce an orange color, such that the metric display 12 produces a light bar 21 that tracks the foot motion of the user on the exercise device and the light bar 21 changes in color from orange to yellow to green to yellow to orange and back again. The number of light bars 21 that are energized in this sequential oscillating pattern is dependent upon the stride or foot motion of the user.

Accordingly, the metric display 12 communicates the user's stride length to the user in a very effective, immediate and a visually appealing manner. Further, the metric display 12 also illustrates the speed of the user's foot motion. The metric display 12 provides direct feedback to the user in a very user-friendly manner and entertaining manner, thereby making the user's experience more enjoyable. The metric display 12 also can make the user's exercise experience more beneficial by providing direct feedback on the user's motion enabling the user to maintain and/or adjust his or her motion to meet his or her desires or goals.

In addition to the metric display 12, a numerical readout of the user's stride length and/or speed can be displayed on the display system 10. The numerical display can be used by the user to further understand or calibrate his or her motion and exercise routine on the exercise device.

The metric displays of FIGS. 4 and 5 are shown as defining part of a circular or annular shape. The circular display configuration extends over approximately 220 degrees, such that the light bars 21 path is capable of extending over a range as great as approximately 220 degrees. In alternative embodiments, the displays can incorporate potential light bar paths that extend less than or greater than 220 degrees. In alternative embodiments, the metric display 12 can include a generally circular shape that extends anywhere within the range of at least approximately 90 degrees to at least approximately 270 degrees. In another alternative embodiment, the metric display 12 can extend as far as a complete circular path. Further, in additional alternative embodiments, the metric display can form other shapes or light bar paths, such as, for example, other arcuate shapes, semi-elliptical shapes, or other curved paths. In other alternative embodiments, the metric display can be formed with one or a plurality of linear segments generally defining a displayed metric.

In other alternative embodiments, an entire stride zone can be illuminated when a user's stride corresponds to that particular zone. In another alternative preferred embodiment, the metric display can incorporate an oscillating needle or other form of indicator that oscillates back and forth tracking the user's motion or other desired metric. The speed and amplitude of the needle's movement can track the speed and length of the user's stride, similar to the above described embodiments.

Figure 9:
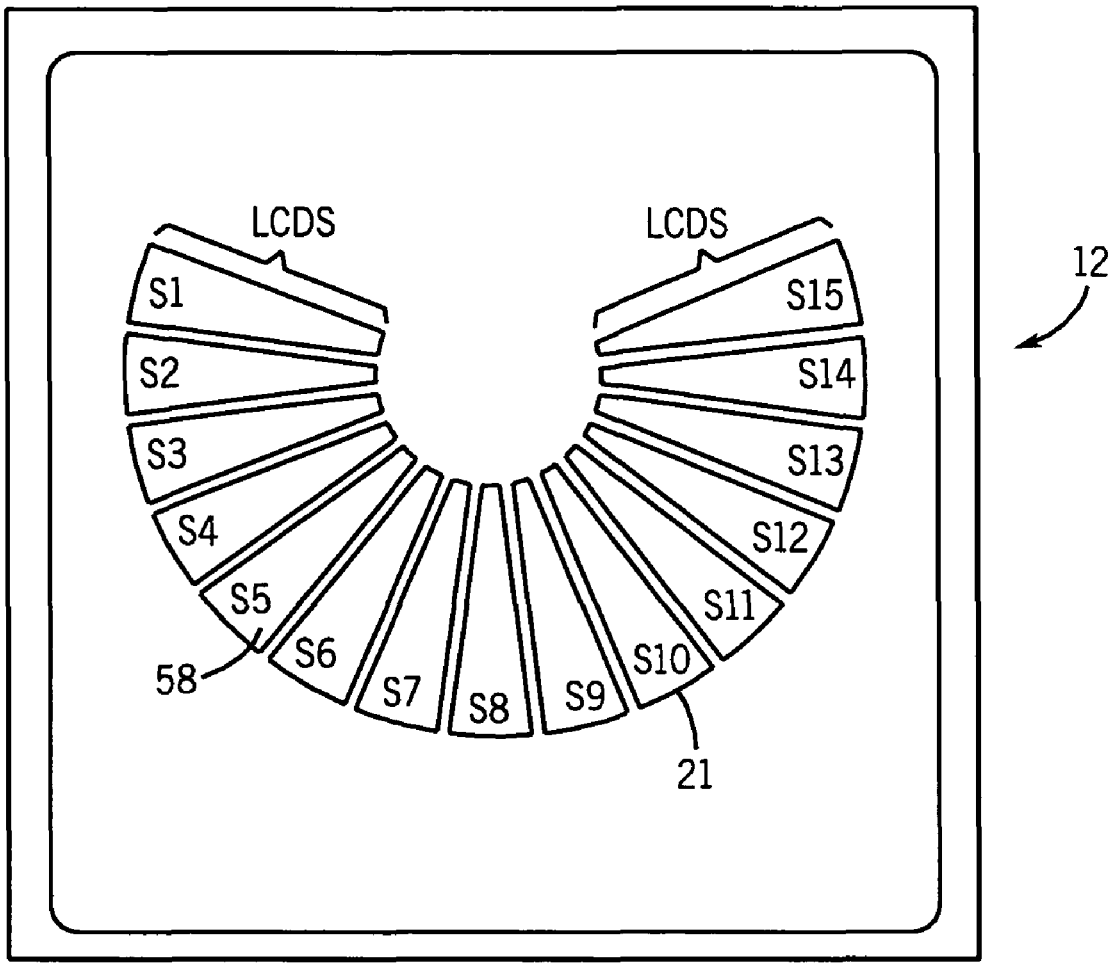
FIG. 9 is a diagram of another embodiment of the metric display for exercise equipment of FIG. 3.
Figure 10:
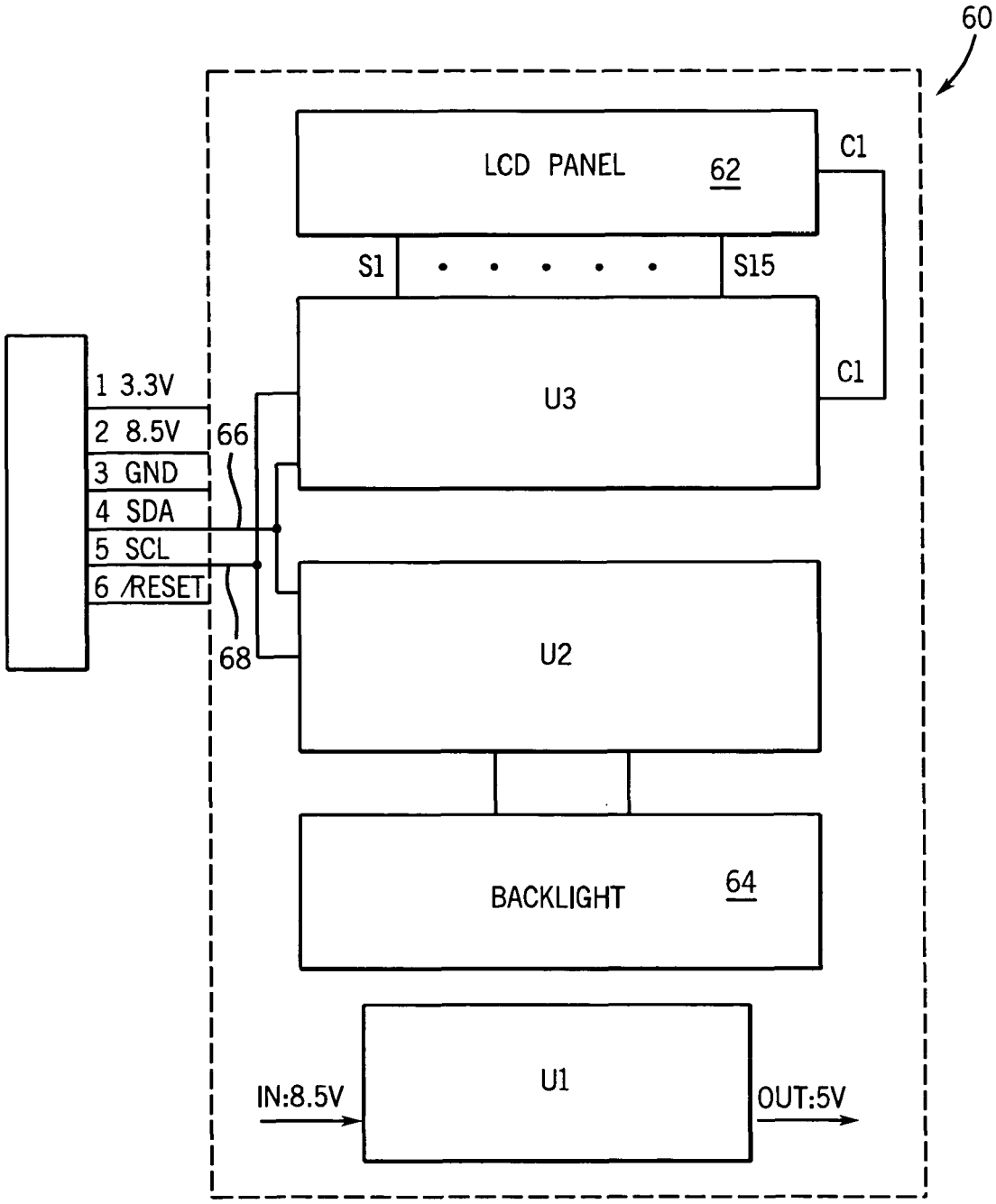
FIG. 10 is a block diagram of the embodiment of the metric display for exercise equipment of FIG. 9.

FIG. 9 is a diagram of another embodiment of the metric display 12 for exercise equipment of FIG. 3. In this embodiment, the display of the present invention can utilize a series of liquid crystal displays (LCDs) 58. The LCD embodiment operates is in a manner similar to the LED embodiment described above. As seen in FIG. 9, each display bar can comprise an LCD bar, in this example fifteen S1 . . . S15. Referring to FIG. 10, a block diagram of example circuitry 60 is described. A LCD panel 62 can be provided having in one embodiment fifteen inputs S1-S15, with each input corresponding to an LCD. The number of inputs can vary depending on the number of LCDs, and the configuration of the LCDs, used in a particular embodiment.

Referring to FIG. 10, a power supply of 8.5 Volts is input into voltage regulator U1 (an adjustable 3-terminal positive voltage regulator). Two external resistors set the output voltage, such as 5.0 Volts. The output of voltage regulator U1 is connected to a driver U2 and LCD controller U3. The driver can be an LED or an LCD driver. The output of U1 is connected to a backlight 64 via the driver U2. A separate power supply of 3.3 Volts can be provided to the backlight 64. The backlight 64 is connected to the driver U2. The driver U2 can include a 2-bit $I^2C$ and SMBus I/O expander optimized for dimming LEDs in 256 discrete steps. The driver U2 contains an internal oscillator with two user-programmable blink rates and duty cycles coupled to the output pulse width modulation (PWM). The brightness of the LEDs or the LCDs is controlled by setting the blink rate high enough that the blinking can not be seen and then using the duty cycle to vary the amount of time the LED or LCD is on and thus the average current through the LED or LCD. One command from the bus master is required to turn individual LEDs or LCDs ON, OFF, BLINK RATE 1 or BLINK RATE 2. Based on the programmed frequency and duty cycle, BLINK RATE 1 and BLINK RATE 2 cause the LEDs or LCDs to appear at a different brightness or blink at periods up to 1.69 second. The open drain outputs directly drive the LEDs or LCDs with maximum output sink current of 25 mA per bit and 50 mA per package.

The active LOW hardware reset pin (/RESET) and Power-On Reset (POR) initialize the registers to their default state causing the bits to be set HIGH (LED off). The driver U2 is input with serial data 66 and a serial clock 68. The serial data 66 and a serial clock 68 are also input into the controller U3. The controller U3 is a peripheral device which interfaces to the LCD panel. The controller U3 generates the drive signals for the LCD panel. U3 communicates via a two-line bidirectional I2C-bus.

Figure 11:
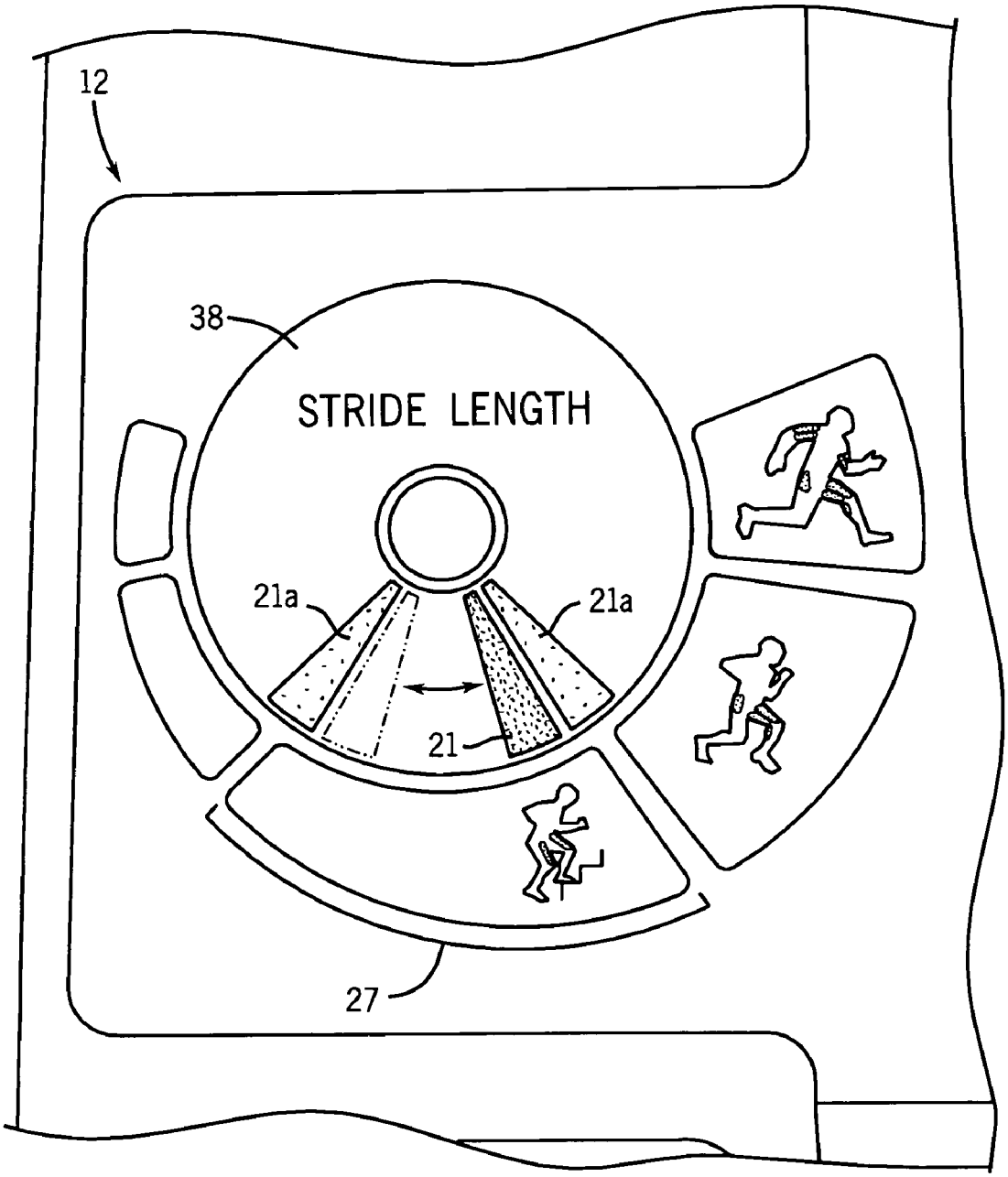
FIG. 11 is a front of the metric display of FIG. 6 in accordance with an alternative embodiment.

Referring to FIG. 11, in an alternative embodiment, the metric display 12 can further include one or more secondary lights bars 21*a*. Each secondary light bar 21*a* can be formed of a plurality of LEDs, or other form of indicator such as, for example, an LCD. The secondary light bar 21*a* can be utilized as a user, program configurable coaching aid or as a peak hold indicator. The one or more secondary light bars 21*a* are configured to indicate a particular location on the metric display 12 or target operating position. For example, the light bars can indicate a longer stride position, such as the light bars 21*a* than currently being maintained by the user as indicated by light bar 21. The location of the light bars 21*a* can be determined, selected and/or configured by the user or a trainer and can be used to indicate to the user the desired stride length (or other metric) to be achieved at that particular point in the user of the exercise device. Alternatively, the location of the light bars 21*a* on the metric display 12 can be automatically determined by one or more selectable user programs available on, or downloadable to, the display system 10. Accordingly, the user or the program will cause the light bars 21*a* to appear at the position desired by the user, the trainer or the Training Program. The light bars 21*a* then provide the user with a real time image of their target operating position on the exercise device in relation to the current operating position on the exercise device. The location of the light bars 21*a* can change based upon the user's desire, the trainer's desire or the training program software.

Alternatively, the light bars 21*a* can be used as a peak hold indicator. Referring to FIG. 11, the light bars 21 can indicate to the user the maximum stride the user obtained during his or her workout (or series of workouts) up to that point in time. Alternatively, the light bars 21*a* can indicate the maximum position of another metric. The peak hold indicator provides the user with an indication of the maximum stride length achieved during at least one point in a prior or current workout on the exercise device. In other alternative embodiments, the metric display can include multiple light bars 21*a* wherein one or more light bars function as a peak hold indicator, and one or more other light bars 21*a* function as a target operating position indicator.

Figure 12:
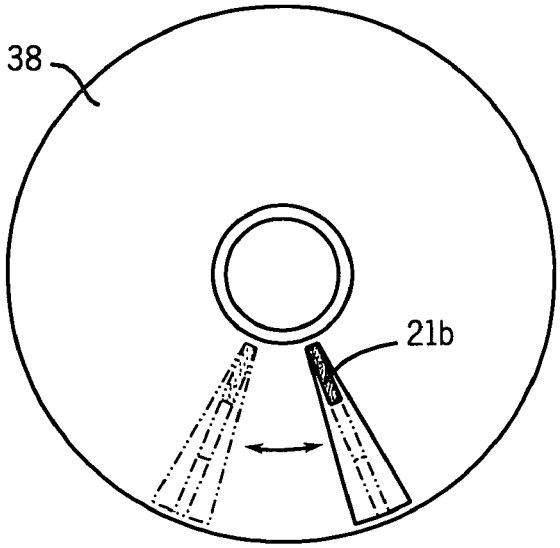
FIGS. 12 through 14 illustrate a front view of multiple positions of a metric display in accordance with an alternative embodiment of the present invention.
Figure 13:
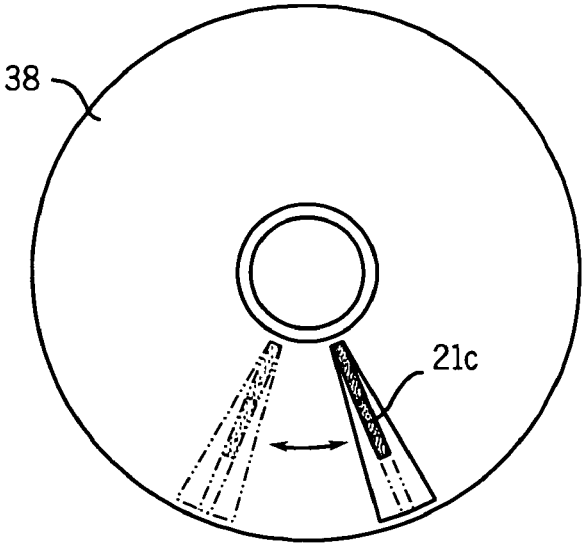
Figure 14:
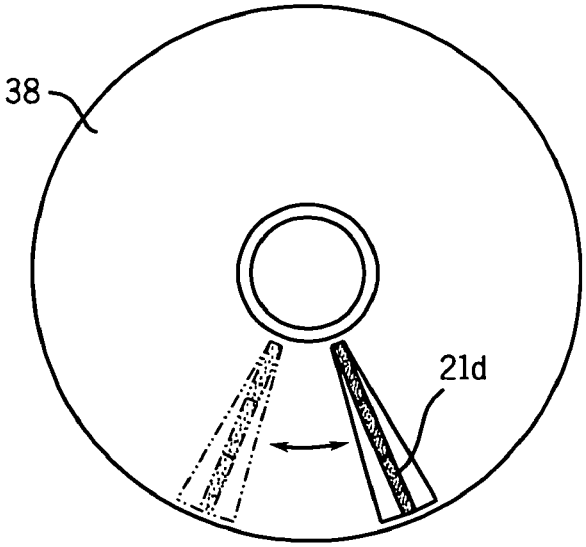

Referring to FIGS. 12 through 14, in another alternative embodiment, the length of the light bar 21 can vary depending upon a separate second metric, for example, resistance. The light bars 21 can be arranged as displayed in FIGS. 3-8, with the light bars radiating outward from point 44 (FIG. 4) of the circuit board 40. When the resistance level is within a lower range, the light bar 21 will continue to follow the first metric, in this instance stride length, and oscillate or otherwise indicate the extent (length) of the stride of the user, but the length of the light bar 21 can be shortened, such as the light bar 21*b* (FIG. 12). Therefore, the light bar 21*b* indicates and tracks the stride of the user and also indicates the amount of resistance applied to the motion of the user by the exercise device. As the resistance level of the exercise device is increased to a medium range, the length of the light bar 21 can also increase, such as indicated with light bar 21*c* (FIG. 13). Further, as the resistance level of the exercise device increases to a high or upper range, the light bar 21 can reach its full length, such as light bar 21*d* (FIG. 14). Accordingly, a metric display 12 can be configured to display first and second metrics with a single indicator, in this example, the oscillating movement and length of the light bar. In alternative embodiments, other metrics can be measured and other parameters of the metric display 12 can be varied to monitor the extent of a metric, such as, for example, the size, shape, color, intensity level (such as brightness), and/or sound of the indicator. When intensity level is employed, the brightness of the light bar can increase as resistance level increases.

When sound is employed, the metric display can be configured to produce audio signals in response to a metric. The volume, pitch, and/or sound pattern of the sound can vary in association with the extent of a metric, thereby providing an alternate or additional approach to communicating the extent of a metric to a user. In one embodiment, referring to FIG. 4, the display electronic board 14 can further include a transducer 45 having a built in speaker. The transducer 45 can be configured to produce a sound or a plurality of sounds to communicate an extent of a metric, such as stride length, of a user on an exercise device.

While preferred embodiments of the present invention have been illustrated and described, it would be appreciated that various changes may be made thereto without departing from the spirit and scope of the present invention. For example, components other than LEDs or LCDs can be used to generate the light of the light bar. In one example, electroluminescent light elements can be used or other existing light generating components.

What is claimed is:

1. A display system for exercise equipment comprising:

a processor;

memory in communication with the processor;

a metric sensor operably coupled to the processor, the metric sensor sensing an extent of a metric of a user's movement of the exercise equipment; and a metric display operably coupled to the metric sensor, the metric display comprising a graphical dial displaying the user metric in an oscillating manner swinging to and fro at a speed based upon the user's movement.

2. The display system of claim 1, wherein the user metric is a stride of the user and the extent is the length of the stride.

3. The display system of claim 1, wherein the user metric is angle of a path defined by the user's foot motion.

4. The display system of claim 1, wherein the user metric is selected from the group consisting of user arm extension; body extension; shape defined by a user's foot motion, and stride height or amplitude of a user's foot motion.

5. The display system of claim 1, wherein the metric display displays the user metric through the use one or more display bars and wherein the display bars contribute to the formation of the generally oscillating display of the extent of the metric.

6. The display system of claim 5, wherein each display bar comprises one or more light emitting diodes.

7. The display system of claim 5, wherein each display bar comprises a liquid crystal display.

8. The display system of claim 5, wherein the display bars are grouped into zones corresponding to different zones of the extent of the metric of the user.

9. The display system of claim 5, wherein the display bars are color coordinated to convey information regarding the extent of the metric of the user.

10. The display system of claim 5, wherein the display bars operate in a sequential, generally oscillating manner.

11. The display system of claim 8, wherein each group of display bars is configured to produce a different color of light.

12. The display system of claim 1, wherein the metric sensor is a position sensor coupled to the exercise equipment and operably coupled to the metric display.

13. The display system of claim 12, wherein the position sensor is an optical sensor.

14. The display system of claim 1, wherein the metric sensor is selected from a group consisting of a displacement sensor, a deflection sensor and a load sensor.

15. The display system of claim 1, wherein the metric display further includes one or more human icons that display graphic information on the extent of the metric.

16. The display system of claim 15, wherein the one or more human icons further display graphic information on the muscle groups being taxed.

17. The display system of claim 1, wherein the metric display includes an operating display region comprising a visible graphic element that oscillates in an arc that defines at least part of a generally circular shape.

18. The display system of claim 17, wherein the at least part of a circular shape extends from at least approximately 90 degrees to at least approximately 270 degrees of the generally circular shape.

19. The display system of claim 1, wherein the metric display includes an operating display region, and wherein the operating display region comprises a visible graphic element that oscillates in an arc that defines a curved shape.

20. The display system of claim 1, wherein the metric display includes an operating display region, and wherein the operating display region comprises a visible graphic element that oscillates so as to define a shape selected from the group consisting of an arcuate shape, at least part of an elliptical shape, one or more linear segments and combinations thereof.

21. The display system of claim 1, wherein the exercise equipment is selected from the group consisting of a pendulum motion-type exercise apparatus, an elliptical exercise device, a treadmill, a cross-country skiing exercise device, and a rowing machine.

22. The display system of claim 1, wherein the metric display further includes a peak hold and/or a target operating position indicator.

23. The display system of claim 1, wherein the metric display further produces an audio signal corresponding to the metric.

24. The display system of claim 1, wherein the user metric is oscillating movement of a portion of the exercise equipment driven by the user and wherein the metric display has a visible portion that synchronously oscillates in response to and in proportion to oscillation of the portion of the exercise equipment.

25. A metric display system for an exercise equipment display system, the metric display system comprising:

a position sensor that senses an extent of a metric of a user of the exercise equipment; and a metric display in communication with the position sensor, the metric display configured to display the metric in a generally oscillating manner proportional to the extent of the metric, wherein the metric display comprises a visible graphic element that visibly swings back and forth based upon the sensed metric.

26. The display system of claim 25, wherein the user metric is a stride of the user and the extent is the length of the stride.

27. The display system of claim 25, wherein the metric display is a graphical dial.

28. The display system of claim 25, wherein the metric display comprises one or more display bars, and wherein the display bars contribute to the production of the generally oscillating appearance of the metric.

29. The display system of claim 28, wherein each display bar comprises one or more light emitting diodes.

30. The display system of claim 28, wherein each display bar comprises a liquid crystal display.

31. The display system of claim 28, wherein the display bars are grouped into zones corresponding to different zones of the extent of the metric of the user.

32. The display system of claim 28, wherein the display bars are color coordinated to convey information regarding the extent of the metric of the user.

33. The display system of claim 32, wherein each group of display bars is configured to produce a different color of light.

34. The display system of claim 25, wherein the metric display further includes one or more human icons that display graphic information on the extent of the metric.

35. The display system of claim 34, wherein the one or more human icons further display graphic information on the muscle groups being taxed.

36. The display system of claim 25, wherein the metric display includes an operating display region comprising a visible graphic element that oscillates in an arc that defines at least part of a generally circular shape.

37. The display system of claim 36, wherein the at least part of a circular shape extends from at least approximately 90 degrees to at least approximately 270 degrees of the generally circular shape.

38. The display system of claim 25, wherein the metric display includes an operating display region, and wherein the operating display region comprises a visible graphic element that oscillates in an arc that defines a curved shape.

39. The display system of claim 25, wherein the metric display further includes a peak hold and/or a target operating position indicator.

40. The display system of claim 25, wherein the metric display further produces an audio signal corresponding to the metric.

41. A display for a user metric on exercise equipment comprising:

a plurality of light bars that display an extent of the user metric, the light bars being grouped into at least first and second zones corresponding to different amounts of the extent of the user metric, the light bars of the first zone producing a light of a first color, and the light bars of the second zone producing a light of a second color that is different from the first color, wherein the user metric is a stride of the user and the extent is the length of the stride, wherein different colors of the light are configured to communicate to the user different ranges of stride lengths of different predefined categories.

42. The display for a user metric of claim 41, wherein each light bar comprises one or more light emitting diodes.

43. The display of claim 42, wherein the light emitting diodes are configured to produce one of the first and second colors.

44. The display of claim 41, wherein each light bar comprises at least one liquid crystal display.

45. The display of claim 41, wherein the metric display is a graphical dial, and wherein the metric display further includes one or more human icons that display graphic information on the extent of the metric.

46. The display of claim 45, wherein the one or more human icons further display graphic information on the muscle groups being taxed.

47. The display of claim 41, wherein the plurality of light bars form an operating display region, and wherein the operating display region defines a curved shape.

48. The display of claim 41, wherein the metric display includes an operating display region, and wherein the operating display region is a shape selected from the group consisting of an arcuate shape, at least part of an elliptical shape, one or more linear segments and combinations thereof.

49. The display system of claim 41, wherein the metric display further includes a peak hold and/or a target operating position indicator.

50. The display system of claim 41, wherein the metric display further produces an audio signal corresponding to the metric.

51. The display of claim 41, wherein the light bars sequentially illuminate to form a visible graphic that swings to and fro.

52. The display of claim 41, wherein the different colors of light are configured to communicate a first range of stride lengths corresponding to a stepping-type of motion and a second range of stride lengths corresponding to a maximum range of stride lengths.

53. The display of claim 41, wherein the different colors of light are configured to communicate a first range of stride lengths corresponding to a safe range of stride lengths and a second range of stride lengths corresponding to an unsafe range of stride lengths.

54. A display system for exercise equipment comprising:

a processor;

memory in communication with the processor;

first and second metric sensors in communication with the processor, the first and second metric sensors sensing an extent of first and second metric of a user's movement on the exercise equipment, respectively; and a metric display operably coupled to the first and second metric sensors, the metric display displaying the first metric in a generally oscillating manner swinging to and fro at a speed based upon the user's movement, wherein the metric display comprises a visible graphic element that visibly swings back and forth based upon the sensed metric.

55. The display system of claim 54, wherein the metric display includes a plurality of light bars that sequentially light to form the visibly graphic element that swing back and forth based upon the sensed a first metric.

56. The display system of claim 55, wherein the brightness of the light bar bars generally corresponds to the extent of the second metric.

57. The display system of claim 56, wherein the second metric is resistance applied to the movement of the exercise device by the user during use.

* * * * *